United States Patent [19]

Schmanski

[11] 4,384,719

[45] May 24, 1983

[54] GOLF PUTTING CLUB INCLUDING BALL RETRIEVAL DEVICE

[76] Inventor: David A. Schmanski, 101 Conestoga, #9, Carson City, Nev. 89701

[21] Appl. No.: 297,984

[22] Filed: Aug. 31, 1981

[51] Int. Cl.[3] ..... A63B 69/36

[52] U.S. Cl. ..... 273/194 R; 273/DIG. 21

[58] Field of Search ..... 273/194 R, 162 R, 193 R, 273/200 R, 58 C, DIG. 21; 43/19

[56] References Cited

U.S. PATENT DOCUMENTS 3,065,563 11/1962 Bascom ..... 273/194 R X 4,239,227 12/1980 Davis ..... 273/194 R

*Primary Examiner*—George J. Marlo

*Attorney, Agent, or Firm*—Thorpe, North & Western

[57] ABSTRACT

A putting device for facilitating retrieval of a golf ball during putting practice wherein a filament line is secured at one end to a golf ball and at the other end to a reel means attached to a putter. When the golf ball has been struck, the player is then free to rewind the filament line into the reel means, pulling the golf ball to its original location adjacent to the putter. The retrieval system includes a reel housed within the handle end of the club shaft. The filament line extends from the reel, downward through the club shaft, through an aperture in the striking face of the putter, and then to the golf ball.

4 Claims, 2 Drawing Figures

GOLF PUTTING CLUB INCLUDING BALL RETRIEVAL DEVICE

BACKGROUND OF THE INVENTION

1. Field of the Invention

This invention pertains to putting devices useful in training and development of putting technique. More specifically, the subject invention relates to such putting devices wherein the golf ball can be returned to the players location, rather than requiring the player to move to the location of the ball after it has been hit.

2. Prior Art

As a sport, golfing has enjoyed popularity for almost 150 years and has experienced numerous innovations designed to improve the skills of the golfer in the various aspects of driving, chipping and putting.

Since putting practice involves less distance and can be accomplished on virtually any flat surface, numerous devices have been developed which are adaptable for use on a carpet, grass turf or artificial surface. Typically, these devices have included a portable cup which is placed on the practice surface and serves as the target of putting practice. To facilitate an automatic return to the player, such cups have been automated with mechanical return devices in which the ball is propelled back to the player by means of a spring loaded or electrical thrusting device.

The disadvantage of such automatic return systems is primarily that the player must successfully put the golf ball into the cup before the automatic return device works. Frequently, therefore, the player must retrieve his golf ball, having missed the putting target.

OBJECTS AND SUMMARY OF THE INVENTION

It is thereore an object of the subject invention to provide a putting practice device which facilitates retrieval of the golf ball regardless of its direction of travel or final location with respect to the cup.

It is a further object of the present invention to provide a putting practice device which may be used on any playing surface with or without a cup and other practice equipment.

It is a still further object of this invention to provide a putting device which includes means for retrieval of the golf ball as part of the putter body.

These and other objects are realized in the putting device of the present invention which facilitates retrieval of a golf ball during putting practice without need of external or independent ball return devices. This invention consists of a putter having a head, shaft and handle sections which conform in shape, weight and configuration to a standard putting club. Attached at the handle of the putter is a reel means which includes means for release and uptake of a variable length of an attached filament line which is secured at one end to the reel means and adapted at its opposite end for attachment to the golf ball. Guide means are attached along the shaft length which have openings therein to define a direction of filament movement which is in substantial parallel alignment with the shaft and extends from the reel means to a terminal opening guide located near the head of the putter. This device enables a player to attach a golf ball at the filament end near the putter head, having the filament disposed along the guide means and stored in the reel means attached to the handle. The reel means is provided with a friction release tab which permits free flow of the filament through the guide means and with the golf ball. After the player has struck the golf ball, the ball may be reeled in by winding up the filament, pulling the golf ball back to the player's location.

These and other objects of the present invention will be apparent to those skilled in the art based on the following detailed description, accompanied by the attached drawings.

DETAILED DESCRIPTION OF THE DRAWINGS

DETAILED DESCRIPTION OF THE INVENTION

Figure 1:
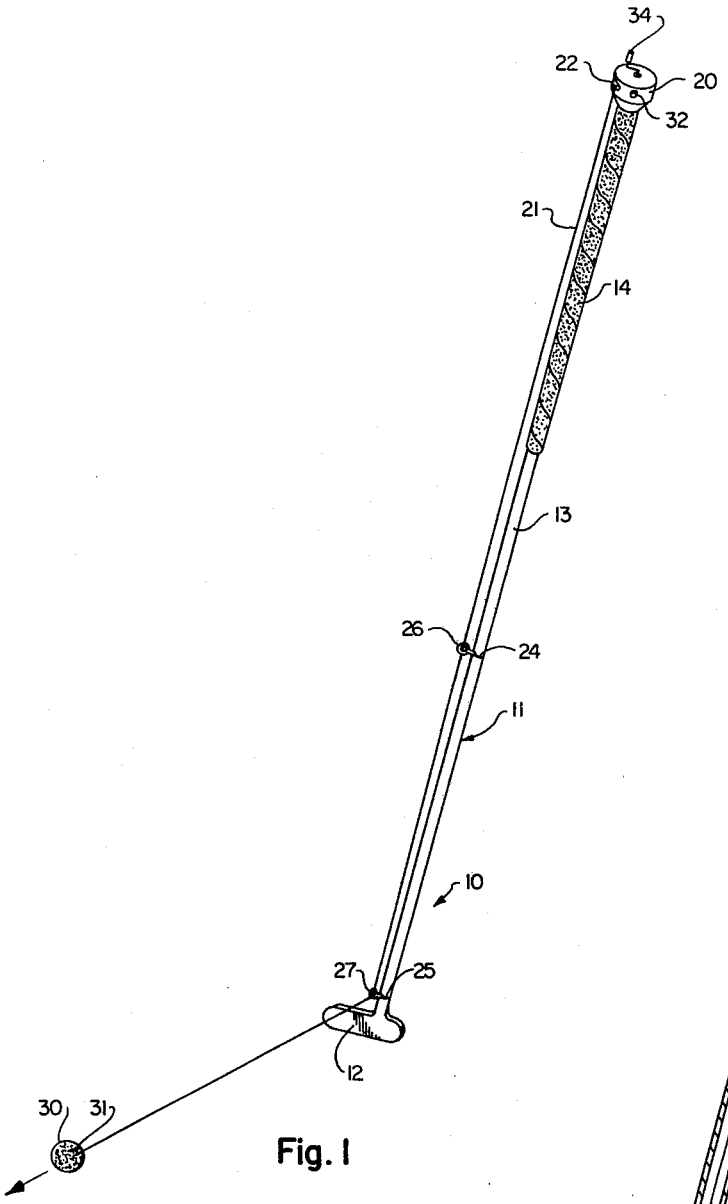
FIG. 1 illustrates the subject invention with the retrieval apparatus attached to the exterior of the putter body.

Referring now to the drawings:

A putting device for facilitating retrieval of a golf ball during putting practice is illustrated in FIG. 1 as item 10. This device consists of a standard putter 11 having a head 12, shaft section 13 and handle section 14. The construction of these elements are well known within the state of the art. In fact, the present invention contemplates the adaption of an existing putter with appropriate apparatus to provide the desired capability to retrieve the practice golf ball.

This adapting structure includes a reel means 20 whose construction and operation is similar to that of a standard spinning reel such as that used in the sport of fishing. This reel means 20 includes means for releasing and uptake of a variable length of an attached filament line 21 which extends from the inner mechanism of the reel means through an opening 22 and down the length of the putter 11.

The filament 21 is maintained in substantial parallel alignment with the putter length 11 by guide means 24 and 25 which are attached along the shaft and which include openings 26 and 27 through which the filament passes, thereby defining the direction of filament movement along the shaft.

This filament is attached at its opposing end to a golf ball 30. Numerous methods of attachment can be utilized to fix the golf ball 30 to the filament 21 in such manner that upon striking the golf ball with the putter head 12, the filament 21 is not released or separated from the golf ball 30, but is rather pulled along the ball's path of movement. This method of attachment may be a pointed spike 31 which can be impressed into the golf ball core with the filament attached at its head. By inserting the spike into a dimple of the golf ball, the spike head does not project beyond the spherical exterior of the golf ball and does not, therefore, cause a distortion in the rolling surface.

The operation of the subject putting device is illustrated by the following sequence. The practicing player fixes the loose filament end at the golf ball 30 in a manner such as previously suggested. The golf ball is then placed in a suitable location for play. This may be on a carpet surface or actual putting green.

A small length of filament line is then released by depressing a tab or catch 32 which operates to permit free, substantially frictionless movement of filament line from the reel means 20. This catch operates similar to the previously referenced casting reel, such as where filament line is retained on a spindle, subject to a line catch or stop which is automatically released upon depression of the catch 32 as illustrated. Sufficient line is released to provide slack needed to permit a rearward swing of the putter without affecting the position of the golf ball. Upon striking the golf ball, the forward movement is developed, with the filament line 21 trailing along the path of movement. It will be apparent that maximum frictionless release of the filament line is desired to provide minimum distortion to the normal golf ball path. To facilitate a natural putting play, the filament should be of minimal weight.

When the golf ball has come to rest, the player can retrieve the ball by rewinding the filament line 21 onto the reel means 20. In FIG. 1 this is accomplished by turning a crank 34 which is coupled to a spindle within the reel means which winds the filament thereon. Accordingly, the golf ball is dragged back to the putter for replay.

It will be apparent that this structure permits release and uptake of variable lengths of line, depending upon how far the ball travels. This structure thereby automatically adapts itself to release only as much line as is actually needed. Therefore, excess slack in the filament line is avoided and chance of entanglement is minimized.

It will be further apparent to those skilled in the art that the apparatus identified in FIG. 1 may be originally manufactured as a single unit, or may be constructed as a modification to an existing putter. For example, the reel means can be clamped to the putter in a similar fashion as a casting reel is attached to a fishing pole. Furthermore, the guide means 24 and 25 can be fixed along the length by any form of wire or clip.

In modifying an existing putter, it would be preferable to maintain the reel means 20 with its center of gravity oriented along the central axis of the shaft 11. This would reduce the unnatural weight distribution which arises from the added weight of the reel means.

Figure 2:
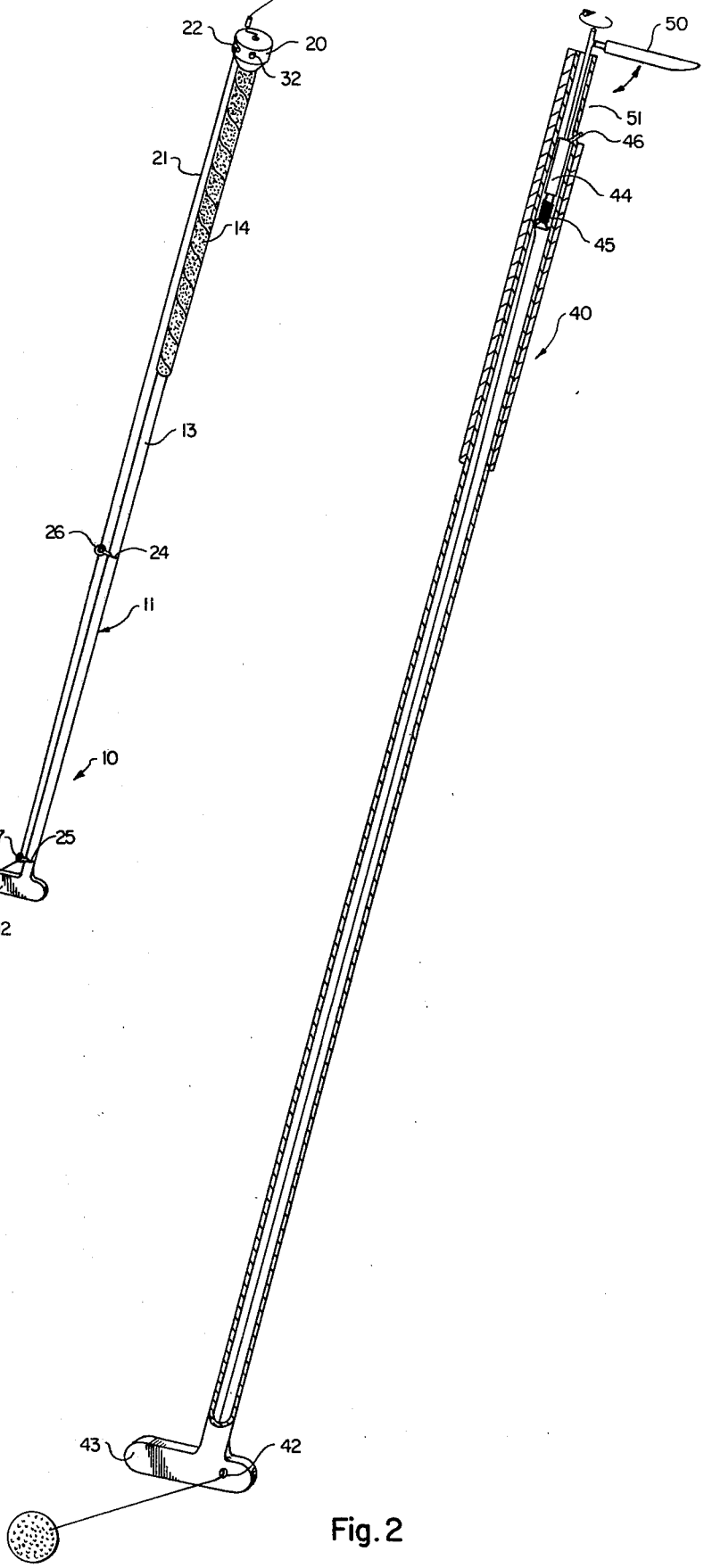
FIG. 2 illustrates a putter with the retrieval components housed within the core of the shaft and handle.

In addition to the external mounted system as illustrated in FIG. 1, an internal retrieval system can be utilized. FIG. 2 shows a putter 40 whose exterior appearance substantially conforms that of any standard putting device. The core of the putter shaft, handle and head, however, is partially hollow to provide a filament path down the shaft length to an outlet 42 which is exposed toward the hitting surface 43 of the putter. In this embodiment, the reel means 44 is housed within the larger upper section of the club. Filament line 47 feeds from an outlet 45 in a manner similar to that shown in FIG. 1 at corresponding opening 22. The inner spindle within the reel means 44 is adjusted to a free, frictionless release mode by depression of a catch 46 similar to the catch 32 illustrated in FIG. 1. In the instance of FIG. 2, the catch is depressed automatically when the crank element 50 is rotated into a slot 51 within the putter handle (phantom lines), thereby contacting the catch 46 and pushing it to the released position. The crank 50 is now in its closed position against the handle of the putter and substantially out of the way of the golfer's hands.

With the putting device in the released mode, the golfer is free to strike the golf ball, with the filament line trailing along its path. The golf ball is retrieved by pulling the crank 50 from its closed position (phantom line) in the handle to an open, rotatable position above the top portion of the putter handle. This same movement releases the catch 46 which permits the crank to drive the spindle in a rotary direction and thereby wind the filament thereon.

This latter structure of FIG. 2 is preferable in design to the extent that the filament line does not encumber the golfer's movement or hand position, nor does the filament line have opportunity to become entangled about the exterior body of the club. This structure also permits improved weight and balance in construction, as well as preserving a preferred asthetic appearance.

It will be apparent to those skilled in the art that the subject invention may be realized by other structural combinations which incorporate the inventive elements described herein. It is, therefore, to be understood that the subject description is exemplary only and that the scope of the invention is to be construed in accordance with the following claims.

What is claimed is:

1. A putting device for facilitating retrieval of a golf ball during putting practice, said device comprising:

(i) a putter having a head and attached shaft and handle sections;

(ii) reel means attached at the handle section, said reel means including means for release and uptake on a variable length of an attached filament, wherein the reel means is attached at the handle section in such a manner so as to align its center of gravity with the central axis of the shaft and handle section of the putter;

(iii) filament line secured at one end to said reel means and adapted at its opposite end with means for attachment to a golf ball; and (iv) guide means comprising a tubular core opening within the handle and shaft of the putter leading to the putter head to retain the filament line protected within the putter body.

2. A putter device as defined in claim 1, wherein the reel means is housed within the handle section of the putter.

3. A putter as defined in claim 2, wherein the means for uptake of filament comprises a reel means with rotating shaft for winding in filament, said shaft having an attached crank which includes hinge means at the point of attachment to enable the crank to collapse from a radially extending uptake position to a closed position along the handle of the putter.

4. A putter as defined in claim 3, wherein the reel means includes a friction release tab which projects toward the closed position of the crank and is responsive to contact with said crank when in the closed position to permit free flow of filament line from the reel means.

* * * * *